US010276123B2

(12) United States Patent
Park et al.

(10) Patent No.: US 10,276,123 B2
(45) Date of Patent: Apr. 30, 2019

(54) DISPLAY APPARATUS AND DRIVING METHOD THEREOF

(71) Applicant: SAMSUNG DISPLAY CO., LTD., Yongin-si, Gyeonggi-do (KR)

(72) Inventors: Junhyun Park, Suwon-si (KR); Sunghwan Kim, Yongin-si (KR); Seyoung Song, Hwaseong-si (KR); Kyoungju Shin, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 495 days.

(21) Appl. No.: 15/051,621

(22) Filed: Feb. 23, 2016

(65) Prior Publication Data

US 2016/0329025 A1 Nov. 10, 2016

(30) Foreign Application Priority Data

May 8, 2015 (KR) ..... 10-2015-0064718

(51) Int. Cl.
*G09G 5/00* (2006.01)
*G09G 3/36* (2006.01)

(52) U.S. Cl.
CPC ..... *G09G 3/3688* (2013.01); *G09G 3/3648* (2013.01); *G09G 2300/0426* (2013.01); *G09G 2310/0248* (2013.01); *G09G 2310/0289* (2013.01); *G09G 2310/0297* (2013.01); *G09G 2320/0219* (2013.01)

(58) Field of Classification Search
None
See application file for complete search history.

(56) References Cited

U.S. PATENT DOCUMENTS 7,183,719 B2 * 2/2007 Yang ..... G09G 3/3216 315/169.4
8,274,451 B2 * 9/2012 Kim ..... G09G 3/3216 315/169.3
2005/0270258 A1 * 12/2005 Shin ..... G09G 3/3275 345/76

(Continued)

FOREIGN PATENT DOCUMENTS

KR 10-2013-0061884 A 6/2013
KR 10-2014-0093357 A 7/2014
KR 10-2014-0109697 A 9/2014

*Primary Examiner* — Kent W Chang
*Assistant Examiner* — Benjamin Morales
(74) *Attorney, Agent, or Firm* — Lewis Roca Rothgerber Christie LLP

(57) ABSTRACT

A display apparatus includes: a display panel including pixels respectively connected to gate lines and data lines; a data driving circuit to output a data output signal in response to a data signal; a demultiplexer circuit to provide first and second data lines from among the data lines with the data output signal, in response to control signals; and a driving controller to provide the data signal and the control signals. The demultiplexer circuit includes: a switching transistor including a first electrode to receive the data output signal, a second electrode connected to the first data line, and a gate electrode connected to a first node; and a switching control circuit to charge the first node to turn on the switching transistor during a first interval of a first horizontal period, and to discharge the first node during a second interval of the first horizontal period.

20 Claims, 9 Drawing Sheets

(56) References Cited

U.S. PATENT DOCUMENTS

| | | | | |
|---|---|---|---|---|
| 2005/0280613 | A1* | 12/2005 | Takei | G09G 3/325 345/76 |
| 2013/0100111 | A1 | 4/2013 | Shirai | |
| 2013/0141320 | A1 | 6/2013 | Kim | |
| 2013/0234954 | A1 | 9/2013 | Koide | |
| 2014/0002435 | A1 | 1/2014 | Huang et al. | |
| 2016/0293093 | A1* | 10/2016 | Seo | G09G 3/20 |

* cited by examiner

DISPLAY APPARATUS AND DRIVING METHOD THEREOF

CROSS-REFERENCE TO RELATED APPLICATION

This patent application claims priority to and the benefit of Korean Patent Application No. 10-2015-0064718, filed on May 8, 2015, the entire content of which is hereby incorporated by reference.

BACKGROUND

One or more aspects of example embodiments of the present disclosure relate to a display apparatus.

In general, a display apparatus includes a display panel for displaying an image, and a data driving circuit and a gate driving circuit to drive the display panel. The display panel includes a plurality of gate lines, a plurality of data lines, and a plurality of pixels. Each of the plurality of pixels includes a switching transistor, a liquid crystal capacitor, and a storage capacitor. The data driving circuit outputs data driving signals to the data lines, and the gate driving circuit outputs gate driving signals for driving the gate lines.

Such a display apparatus may display an image by applying a gate-on voltage to a set or predetermined gate line through the gate driving circuit, and providing data lines with a data voltage corresponding to an image signal through the data driving circuit.

Recently, as the size of the display panel is increased, the number of data lines is increased. Since the number of data lines that may be driven by a data driving circuit IC is limited, the number of data driving circuits ICs in a display apparatus becomes greater as the size of the display panel becomes larger.

SUMMARY

One or more aspects of embodiments of the present disclosure provide a display apparatus having a reduced number of data driving circuits ICs.

One or more aspects of embodiments of the present disclosure provide a method for driving a display apparatus, capable of preventing or substantially preventing the quality deterioration of displayed images even though the number of data driving circuit ICs is reduced.

According to an embodiment of the inventive concept, a display apparatus includes: a display panel including a plurality of pixels respectively connected to a plurality of gate lines and a plurality of data lines; a data driving circuit configured to output a data output signal in response to a data signal; a demultiplexer circuit configured to provide first and second data lines from among the plurality of data lines with the data output signal outputted from the data driving circuit, in response to control signals; and a driving controller configured to provide the data driving circuit with the data signal, and to provide the demultiplexer circuit with the control signals, wherein the demultiplexer circuit includes: a switching transistor including a first electrode configured to receive the data output signal, a second electrode connected to the first data line, and a gate electrode connected to a first node; and a switching control circuit configured to charge the first node in response to the control signals to turn on the switching transistor during a first interval of a first horizontal period, and to discharge the first node during a second interval of the first horizontal period in response to the control signals.

In an embodiment, the control signals provided from the driving controller may include a selection signal and a precharge signal; and the switching control circuit may be configured to charge the first node in response to the selection signal and the precharge signal to turn on the switching transistor during the first interval of the first horizontal period.

In an embodiment, the switching control circuit may include: a precharge transistor including a first electrode configured to receive the precharge signal, a second electrode connected to the first node, and a control electrode to be controlled by the precharge signal; and a capacitor connected between a source line of the selection signal and the first node.

In an embodiment, the precharge signal and the selection signal may include pulse signals that are sequentially activated during the first interval of the first horizontal period.

In an embodiment, a pulse width of the precharge signal may be smaller than a pulse width of the selection signal.

In an embodiment, the control signals provided from the driving controller may include a discharge signal, and the switching control circuit may be configured to discharge the first node in response to the discharge signal to turn off the switching transistor during the second interval of the first horizontal period.

In an embodiment, the switching control circuit may include a discharge transistor including a first electrode connected to the first node, a second electrode connected to ground, and a control electrode to be controlled by the discharge signal.

In an embodiment, the discharge signal may include a pulse signal activated during the second interval of the first horizontal period.

In an embodiment, the data driving circuit may be configured to output a first data output signal provided to the pixels connected to the first data line during the first interval of the first horizontal period, and to output a second data output signal provided to the pixels connected to the second data line during the second interval of the first horizontal period.

In an embodiment, the display apparatus may further include: a gate driving circuit configured to drive the plurality of gate lines, wherein the driving controller may be configured to control the gate driving circuit to sequentially drive the plurality of gate lines.

In an embodiment, the gate driving circuit may be arranged adjacent to one side of the display panel.

In an embodiment, the display apparatus may further include: a first gate driving circuit configured to drive one group of gate lines from among the plurality of gate lines; and a second gate driving circuit configured to drive another group of gate lines from among the plurality of gate lines, wherein the driving controller may be configured to control the first and second gate driving circuits to sequentially drive the plurality of gate lines.

In an embodiment, the first gate driving circuit may be arranged adjacent to a first side of the display panel, and the second gate driving circuit may be arranged adjacent to a second side of the display panel facing the first side.

In an embodiment, each of the first and second gate driving circuits may include an oxide semiconductor TFT gate (OSG) driver.

According to an embodiment of the inventive concept, a method for driving a display apparatus includes: outputting a data output signal in response to a data signal; electrically connecting the data output signal and a first data line to provide the first data line with the data output signal, in response to a precharge signal; electrically connecting the data output signal and the first data line to provide the first data line with the data output signal, in response to a selection signal; preventing a data output end and the first data line from being electrically connected, in response to a discharge signal; and providing a second data line with the data output signal from the data output end.

In an embodiment, the precharge signal and the selection signal may include pulse signals that may be sequentially activated during a first interval of a first horizontal period.

In an embodiment, a pulse width of the precharge signal may be smaller than a pulse width of the selection signal.

In an embodiment, the discharge signal may include a pulse signal activated during a second interval of the first horizontal period.

In an embodiment, the outputting of the data output signal in response to the data signal may include: outputting a first data output signal to pixels connected to the first data line during the first interval of the first horizontal period; and outputting a second data output signal to pixels connected to the second data line during the second interval of the first horizontal period.

According to an embodiment of the inventive concept, a system for driving a display apparatus includes: means for outputting a data output signal in response to a data signal; means for electrically connecting the data output signal and a first data line to provide the first data line with the data output signal, in response to a precharge signal; means for electrically connecting the data output signal and the first data line to provide the first data line with the data output signal, in response to a selection signal; means for preventing a data output end and the first data line from being electrically connected, in response to a discharge signal; and means for providing a second data line with the data output signal from the data output end.

BRIEF DESCRIPTION OF THE FIGURES

The above and other aspects and features of the inventive concept will become apparent to those skilled in the art from the following detailed description of the exemplary embodiments with reference to the accompanying drawings.

DETAILED DESCRIPTION

Figure 1:
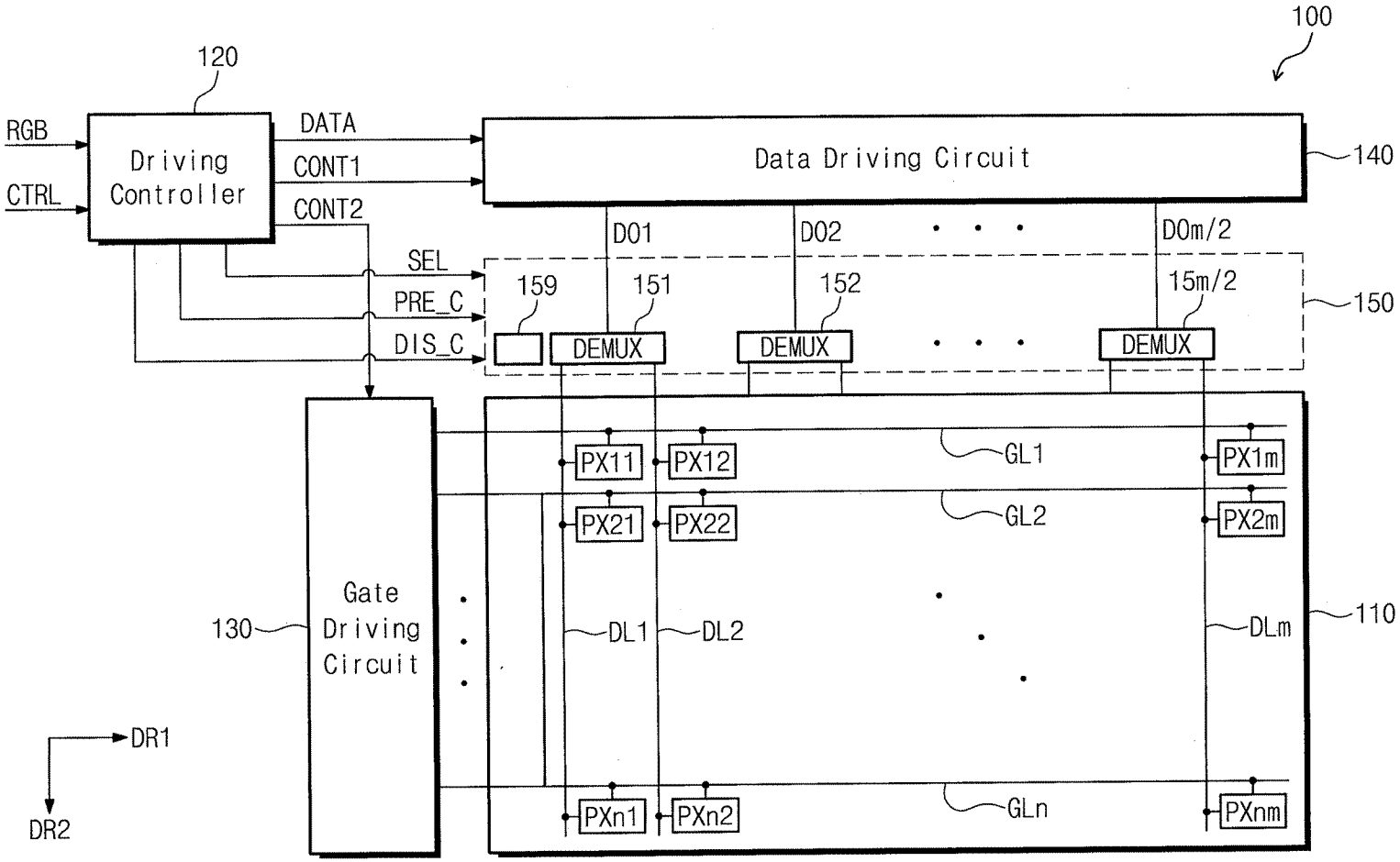
FIG. 1 is a view schematically illustrating a configuration of a display apparatus according to an embodiment of the inventive concept.

Hereinafter, exemplary embodiments of the inventive concept will be described in more detail with reference to the accompanying drawings. The inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

Figure 2:
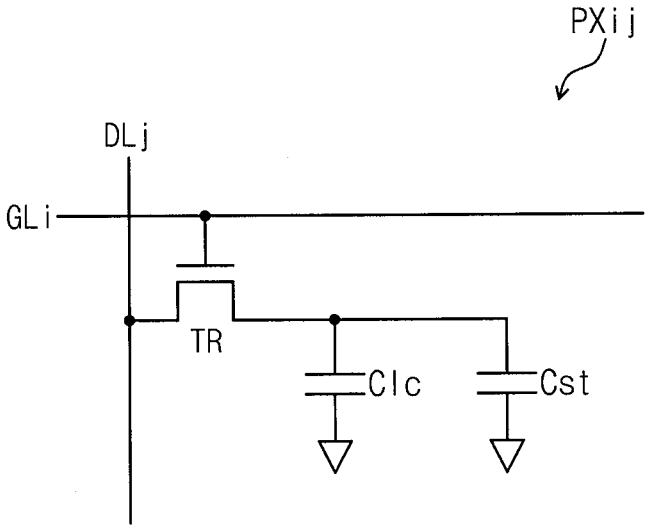
FIG. 2 is an equivalent circuit diagram of a pixel according to an embodiment of the inventive concept.
Figure 3:
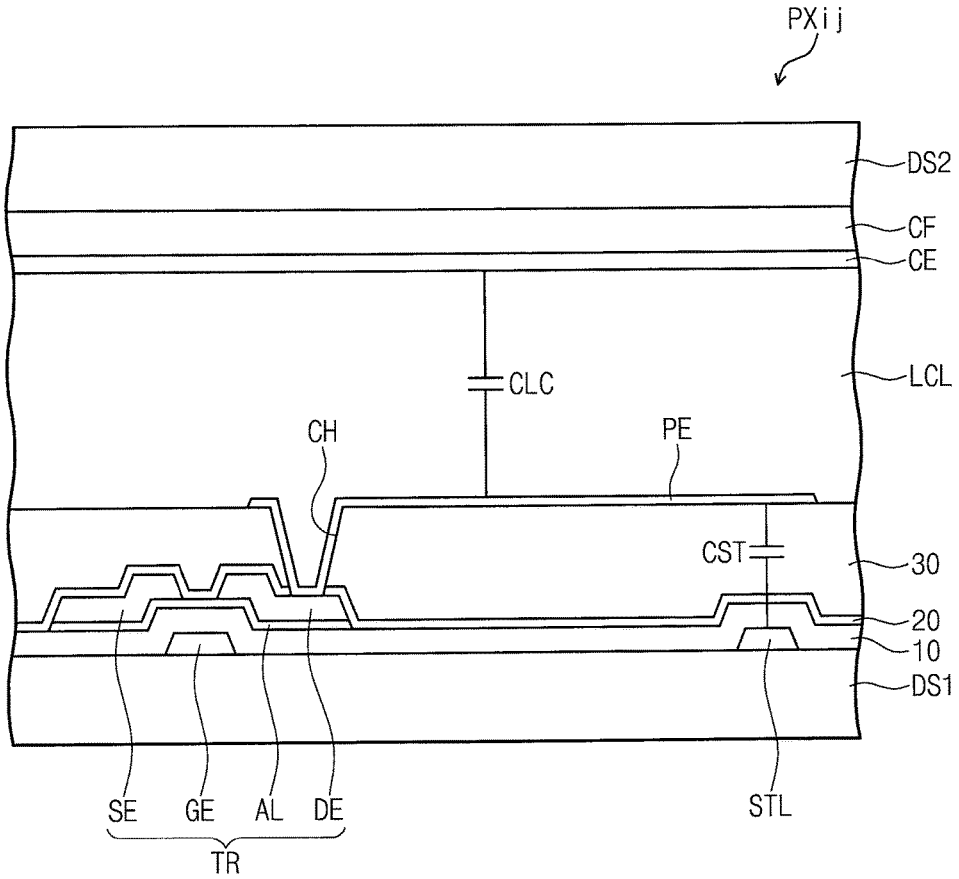
FIG. 3 is a cross-sectional view illustrating a pixel according to an embodiment of the inventive concept.

FIG. 1 is a view schematically illustrating a configuration of a display apparatus according to an embodiment of the inventive concept. FIG. 2 is an equivalent circuit diagram of a pixel according to an embodiment of the inventive concept. FIG. 3 is a cross-sectional view illustrating a pixel according to an embodiment of the inventive concept.

Referring to FIG. 1, the display apparatus 100 includes a display panel 110, a driving controller 120, a gate driving circuit 130, a data driving circuit 140, and a demultiplexer circuit 150.

The display panel 110 may include, but is not particularly limited to, various ones of display panels, for example, liquid crystal display panels, organic light emitting display panels, electrophoretic display panels, electrowetting display panels, etc. In one or more embodiments, the display panel 210 is described as a liquid crystal display panel. A display apparatus including the liquid crystal display panel may further include a polarizer, a backlight unit (e.g., a backlight or backlight source), etc.

The display panel 110 includes a plurality of gate lines GL1 to GLn extending in a first direction DR1, a plurality of data lines DL1 to DLm extending in a second direction DR2, and a plurality of pixels respectively connected to the plurality of gate lines GL1 to GLn and the plurality of data lines DL1 to DLm. FIG. 1 illustrates only some of the plurality of gate lines GL1 to GLn and only some of the plurality of data lines DL1 to DLm.

FIG. 1 also illustrates only some of the plurality of pixels PX11 to PXnm. Each of the plurality of pixels PX11 to PXnm are connected to a corresponding gate line of the plurality of gate lines GL1 to GLn and a corresponding data line of the plurality of data lines DL1 to DLm.

The plurality of pixels PX11 to PXnm may be subdivided into a plurality of groups according to the colors being displayed. The plurality of pixels PX11 to PXnm may display one of the primary colors. The primary colors may include red, green, blue, and/or white. However, the primary colors are not limited thereto, and may further include various other colors, such as yellow, cyan, and/or magenta.

As illustrated in FIG. 2, a pixel PXij includes a pixel thin film transistor TR (hereinafter, referred to as a pixel transistor), a liquid crystal capacitor CLC, and a storage capacitor CST. Hereinafter, a transistor refers to a thin film transistor. The storage capacitor CST may be omitted according to one or more embodiments of the inventive concept.

The pixel transistor TR is electrically connected to the ith gate line GLi and the jth data line DLj. The pixel transistor TR outputs a pixel voltage corresponding to a data signal received from the jth data line DLj in response to a gate signal received from the ith gate line GLi.

The liquid crystal capacitor CLC charges the pixel voltage outputted from the pixel transistor TR. The alignment of liquid crystal directors included in a liquid crystal layer LCL (see FIG. 3) is changed according to an amount of electrical charge charged in the liquid crystal capacitor CLC. Light incident to the liquid crystal layer is transmitted or blocked according to the alignment of the liquid crystal directors.

The storage capacitor CST is connected in parallel to the liquid crystal capacitor CLC. The storage capacitor CST maintains or substantially maintains the alignment of the liquid crystal directors for a time (e.g., a predetermined time).

As illustrated in FIG. 3, the pixel transistor TR includes a control electrode GE connected to the ith gate line GLi (see FIG. 2), an activation layer AL overlapping the control electrode GE, an input electrode SE connected to the jth data line DLj, and an output electrode DE spaced apart from the input electrode SE.

The liquid crystal capacitor CLC includes a pixel electrode PE and a common electrode CE. The storage capacitor CST includes the pixel electrode PE and a portion of a storage line STL overlapping (e.g., overlapped by) the pixel electrode PE.

The ith gate line GLi and the storage line STL are arranged on a surface of a first substrate DS1. The control electrode GE is branched from the ith gate line GLi. The ith gate line GLi and the storage line STL may include metal, such as, aluminum (Al), silver (Ag), copper (Cu), molybdenum (Mo), chromium (Cr), tantalum (Ta), titanium (Ti), and/or an alloy thereof. The ith gate line GLi and the storage line STL may include a multilayer structure, for example, a titanium layer and a copper layer.

A first insulation layer 10 covering the control electrode GE and the storage line STL is arranged on one surface of the first substrate DS1. The first insulation layer 10 may include at least any one of an inorganic material and an organic material. The first insulation layer 10 may be an organic film or an inorganic film. The first insulation layer 10 may include a multilayer structure, for example, a silicon nitride layer and a silicon oxide layer.

The activation layer AL overlapping the control electrode GE is arranged on the first insulation layer 10. The activation layer AL is formed of an oxide semiconductor, and forms a channel of a thin film transistor TR. The oxide semiconductor used for the activation layer AL may be formed of a material including an oxide of zinc (Zn), indium (In), gallium (Ga), tin (Sn), and/or a combination thereof, for example, IGZO, ZnO, ZTO, ZIO, InO, TiO, etc. In other embodiments, the activation layer AL may be formed of amorphous silicon and polysilicon.

The output electrode DE and the input electrode SE are arranged on the activation layer AL. The output electrode DE and the input electrode SE are spaced apart from each other. Each of the output electrode DE and the input electrode SE partially overlaps the control electrode GE.

A second insulation layer 20 covering the activation layer AL, the output electrode De, and the input electrode SE is arranged on the first insulation layer 10. The second insulation layer 20 may include at least any one of an inorganic material and an organic material. The second insulation layer 20 may be an organic film or an inorganic film. The second insulation layer 20 may include a multilayer structure, for example, a silicon nitride layer and a silicon oxide layer.

In FIG. 3, the pixel transistor TR having a staggered structure is exemplarily illustrated, but the structure of the pixel transistor TR is not limited thereto. For example, in some embodiments, the pixel transistor TR may have a planar structure.

A third insulation layer 30 is arranged on the second insulation layer 20. The third insulation layer 30 provides a smooth surface. The third insulation layer 30 may include an organic material.

The pixel electrode PE is arranged on the third insulation layer 30. The pixel electrode PE is connected to the output electrode DE through a contact hole CH penetrating the second and third insulation layers 20 and 30. In some embodiments, an alignment film covering the pixel electrode PE may be arranged on the third insulation layer 30.

A color filter layer CF is arranged on one surface (e.g., on a lower surface) of the second substrate DS2. A common electrode CE is arranged on the color filter layer CF (e.g., on a lower surface of the color filter layer CF so that the color filter layer CF is between the second substrate DS2 and the common electrode CE). A common voltage is applied to the common electrode CE. The common voltage has a value different from that of the pixel voltage. In some embodiments, the alignment layer covering the common electrode CE may be arranged on the common electrode CE. In some embodiments, another insulation layer may be arranged between the color filter CF and the common electrode CE.

The pixel electrode PE and the common electrode CE with the liquid crystal layer LCL therebetween define the liquid crystal capacitor CLC. Also, portions of the pixel electrode PE and the storage line STL with the first, second, and third insulation layers 10, 20, and 30 therebetween define the storage capacitor CST. The storage line STL receives a storage voltage with a value different from that of the pixel voltage. The storage voltage may have the same or substantially the same value as that of the common voltage.

A cross-section of the pixel PXij illustrated in FIG. 3 is only one example. Unlike the illustration of FIG. 3, at least any one of the color filter layer CF and the common electrode CE may be arranged on the first substrate DS1. In other words, the liquid crystal panel according to one or more embodiments may include pixels in a vertical alignment (VA) mode, a patterned vertical alignment (PVA) mode, an in-plane switching (IPS) mode, a fringe field switching (FPS) mode, and/or a plane to line switching (PLS) mode.

Referring again to FIG. 1, in response to an image signal RGB and a control signal CTRL, which are provided from the outside, the driving controller 120 provides the data driving circuit 140 with a data signal DATA and a first control signal CONT1, and provides the gate driving circuit 130 with a second control signal CONT2. Also, the driving controller 120 provides the demultiplexer circuit 150 with a selection signal SEL, a precharge signal PRE_C, and a discharge signal DIS_C.

The gate driving circuit 130 sequentially drives the plurality of gate lines GL1 to GLn in response to the second control signal CONT2 received from the driving controller 120. The data driving circuit 140 outputs data output signals DO1 to DOm/2 to drive the plurality of data lines DL1 to DLm in response to the data signal DATA and the first control signal CONT1 received from the driving controller 120. For example, the data output signal DO1 is provided to the first and second data lines DL1 and DL2 through the demultiplexer circuit 150, the data output signal DO2 is provided to the third and fourth data lines DL3 and DL4 through the demultiplexer circuit 150, and the data output signal DOm/2 is provided to the (m−1)th and mth data lines DLm−1 and DLm through the demultiplexer circuit 150.

Since the data driving circuit 140 may drive two data lines by a data output signal outputted through one data output terminal, the number of the data driving circuits 140 used for a display apparatus may be reduced.

The data output signals DO1 to DOm/2 may include positive data voltages having positive values and/or negative data voltages having negative values, with respect to the common voltage. Some of the data output signals DO1 to DOm/2 applied to the data lines DL1 to DLm may have positive polarity, and some of the data output signals DO1 to DOm/2 applied to the data lines DL1 to DLm may have negative polarity. The polarity of the data output signals DO1 to DOm/2 may be inverted for every frame to prevent or reduce the deterioration of liquid crystals. The data driving circuit 140 may generate data voltages inverted for each frame interval in response to an inverting signal.

The demultiplexer circuit 150 includes a switching control circuit 159 and a plurality of demultiplexers 151 to 15*m*/2. In response to a selection signal SEL, a precharge signal PRE_C, and a discharge signal DIS_C (transmitted from the driving controller 120), the switching control circuit 159 controls switching operations of the plurality of demultiplexers 151 to 15*m*/2.

The plurality of demultiplexers 151 to 15*m*/2 respectively correspond to the data output signals DO1 to DOm/2 outputted from the data driving circuit 140. Each of the demultiplexers 151 to 15*m*/2 sequentially outputs the corresponding data output signal to two data lines. For example, the demultiplexer 151 sequentially provides the first and second data lines DL1 and DL2 with the data output signal DO1. The demultiplexer 152 sequentially provides the third and fourth data lines DL3 and DL4 with the data output signal DO2. Likewise, the demultiplexer 15*m*/2 sequentially provides the (m−1)th and mth data lines DLm−1 and DLm with the data output signal DOm/2. The demultiplexer circuit 150 may be formed in a region (e.g., a predetermined region or area) of the display panel 110 adjacent to the data driving circuit 140, or may be formed on a separate circuit board.

Figure 4:
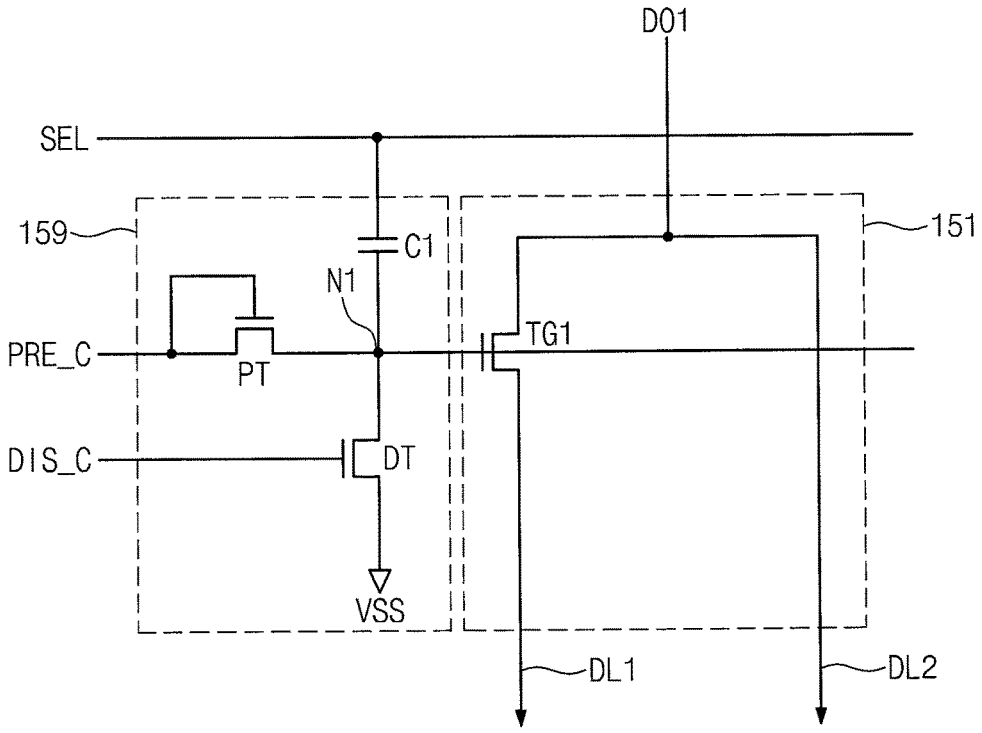
FIG. 4 is a view exemplarily illustrating configurations of a switching circuit and a demultiplexer in the demultiplexer circuit illustrated in FIG. 1.

FIG. 4 is a view exemplarily illustrating configurations of a switching circuit and a demultiplexer in the demultiplexer circuit illustrated in FIG. 1. Although only the demultiplexer 151 in the demultiplexer circuit 150 is illustrated in FIG. 4 and described, other demultiplexers 152 to 15*m*/2 may have the same or substantially the same circuit configuration, and may similarly operate.

Referring to FIG. 4, the switching control circuit 159 includes a precharge transistor PT, a discharge transistor DT, and a capacitor C1. The precharge transistor PT includes a first electrode connected to the precharge signal PRE_C (e.g., a source, line, or terminal for transmitting the precharge signal PRE_C), a second electrode connected to a first node N1, and a control electrode to be controlled by the precharge signal PRE_C. The precharge transistor PT has a diode-connected structure. The discharge transistor DT includes a first electrode connected to the first node N1, a second electrode connected to a voltage VSS (e.g., a ground voltage), and a control electrode connected to the discharge signal DIS_C (e.g., a source, line, or terminal for transmitting the discharge signal DIS_C). The capacitor C1 is connected between the selection signal SEL (e.g., a source, line, or terminal for transmitting the selection signal SEL) and the first node N1.

The demultiplexer 151 includes a switching transistor TG1 having a first electrode connected to the data output signal DO1 (e.g., a source, line, or terminal for transmitting the data output signal DO1), a second electrode connected to the first data line DL1, and a gate electrode connected to the first node N1.

Figure 5:
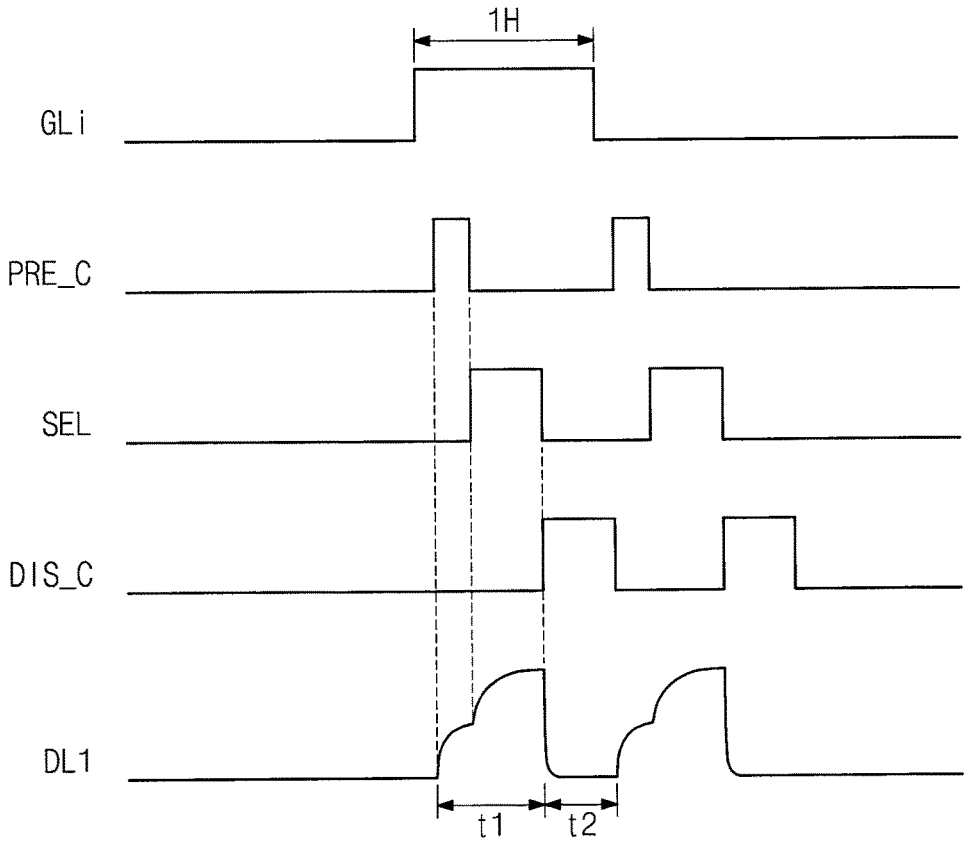
FIG. 5 is a timing diagram of an operation of the demultiplexer illustrated in FIG. 4.

FIG. 5 is a timing diagram of an operation of the demultiplexer illustrated in FIG. 4.

Referring to FIGS. 4 and 5, the precharge signal PRE_C, the selection signal SEL, and the discharge signal DIS_C are sequentially activated to a high level during one horizontal period 1H, during which the ith gate line GLi of the gate lines illustrated in FIG. 1 is driven with a high-level gate driving signal.

First, when the precharge signal PRE_C is activated to the high level, the precharge transistor PT is turned on to increase the voltage at the first node N1 to a level of the precharge signal PRE_C. The switching transistor TG1 is turned on as the voltage of the first node N1 increases. Here, the data output signal DO1 is provided to the first data line DL1 through the switching transistor TG1. When the precharge signal PRE_C is transited to a low level, the precharge transistor PT is turned off.

When the selection signal SEL is transited to a high level, the voltage of the first node N1 increases from a voltage level of the precharge signal PRE_C by a voltage level of the selection signal SEL by virtue of the capacitor C1. As a signal with a high voltage (for example, 30V) is provided to the control electrode of the switching transistor TG1, the switching transistor is sufficiently (e.g., effectively) turned on, and the data output signal DO1 is transferred to the first data line DL1.

When the discharge signal DIS_C is transited to a high level, the first node N1 is discharged to a ground voltage VSS. Therefore, the switching transistor TG1 is turned off.

The data output signal DO1 sequentially outputs a data signal D1 that is to be provided to a first data line DL1, and a data signal D2 that is provided to the second data line DL2, during one horizontal period 1H. When the switching transistor TG1 is turned on, the first data signal D1 is provided to each of the first and second data lines DL1 and DL2. When the switching transistor TG1 is turned off, the second data signal D2 is provided to the second data line DL2, but not to the first data line DL1.

The switching transistor TG1 may have a large channel width (for example, 500 um or more) to sufficiently (e.g., effectively) transfer the data output signal DO1 to the first data line DL1. The large channel width of the switching transistor TG1 may cause an increase in parasitic capacitance between the control electrode of the switching transistor TG1 and the first data line DL1, an increase in kickback voltage level, and/or the like. Thus, a brightness difference of a displayed image may result.

Since the switching control circuit 159 illustrated in FIG. 4 provides the control electrode of the switching transistor TG1 with a high voltage signal, charging ratios of pixels connected to the first data line DL1 may be enhanced.

Also, after the data line DL1 is precharged by the precharge signal PRE_C, the data output signal DO1 is transferred to the data line DL1 while the selection signal SEL is at a high level, and thus, the charging time of pixels connected to the data line DL1 is increased. That is, the first interval t1 of the first horizontal period 1H is set sufficiently long, so that the charging ratios of the pixels connected to the first data line DL1 may be enhanced.

The second data line DL2 directly receives the data output signal DO1. That is, according to some embodiments, since a switching transistor is not connected between the data output signal DO1 and the second data line DL2, signal loss on a path through which the data output signal DO1 is provided to the pixels is small. Therefore, although a second interval t2 during which the second data signal D2 is provided to the second data line DL2 is shorter than the first interval t1, there is no difference (or negligible difference) in brightness between pixels connected to the first and second data lines DL1 and DL2.

Figure 6:
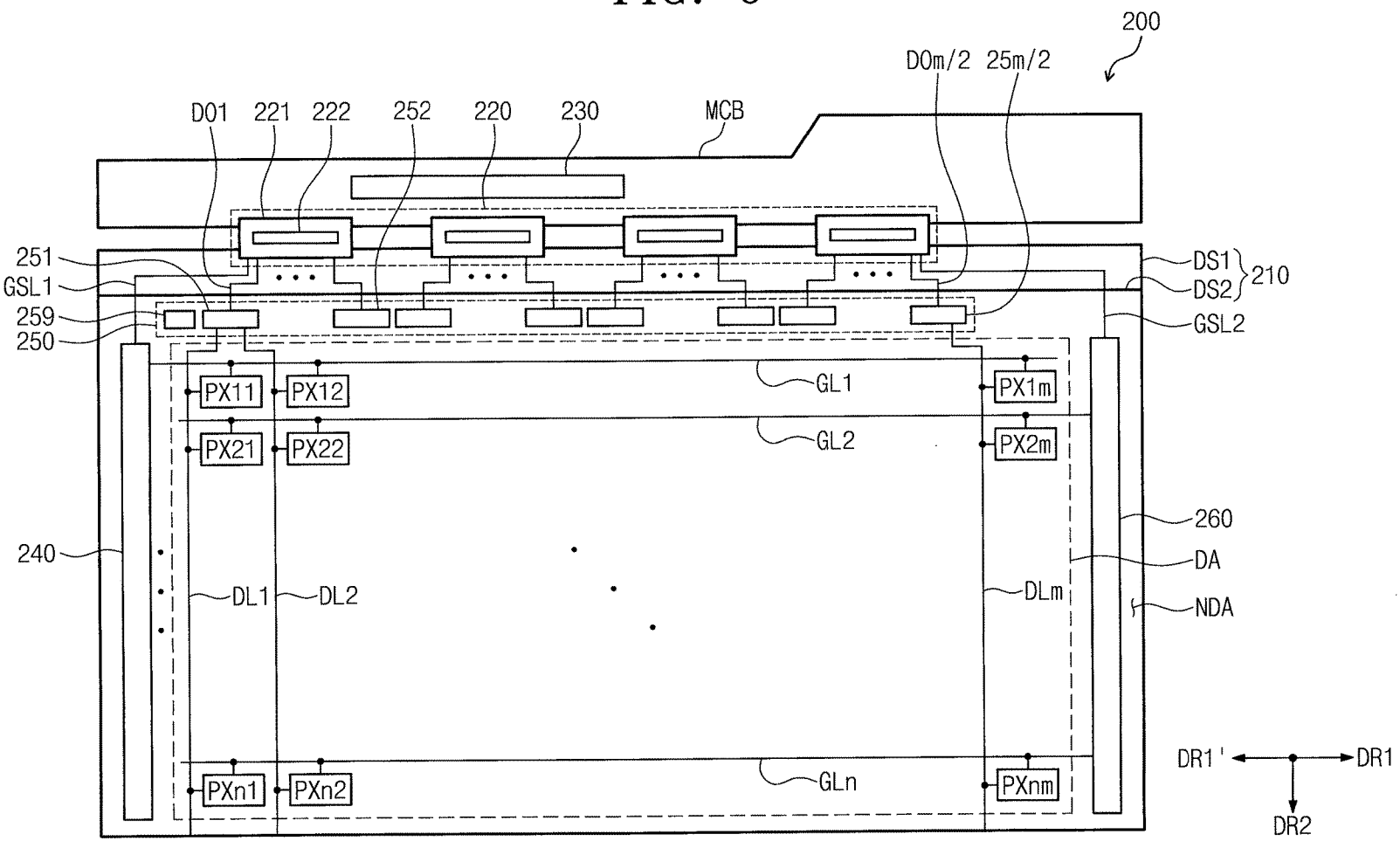
FIG. 6 is a plan view illustrating a display apparatus according to another embodiment of the inventive concept.

FIG. 6 is a plan view illustrating a display apparatus according to another embodiment of the inventive concept.

Referring to FIG. 6, the display apparatus 200 includes a display panel 210, a first gate driving circuit 240, a second gate driving circuit 260, a data driving circuit 220, a driving controller 230, and a demultiplexer circuit 250.

The display panel 210 may include, but not particularly limited to, various display panels, for example, liquid crystal display panels, organic light emitting display panels, electrophoretic display panels, electrowetting display panels, etc. In one or more embodiments, the display panel 210 is described as a liquid crystal display panel.

The display panel 210 includes a first substrate DS1, a second substrate DS2 spaced apart from the first substrate DS1, and a liquid crystal layer between the first and second substrates DS1 and DS2. From a plan view, the display panel 210 includes a display region DA, in which a plurality of pixels PX11 to PXnm are arranged, and a non-display region NDA surrounding the display region DA.

The display panel 210 includes a plurality of gate lines GL1 to GLn arranged on the first substrate DS1 and a plurality of data lines DL1 to DLm crossing the gate lines GL1 to GLn. One group of gate lines GL1 to GLn−1 from among the plurality of gate lines GL1 to GLn extend in a first direction DR1 from the first gate driving circuit 240, and another group of gate lines GL2 to GLn extend in a third direction DR1' from the second gate driving circuit 260. The plurality of data lines DL1 to DLm extend in a second direction DR2 from the demultiplexer circuit 250.

The one group of gate lines GL1 to GLn−1 are connected to the first gate driving circuit 240. The other group of gate lines GL2 to GLn are connected to the second gate driving circuit 260. The plurality of data lines DL1 to DLm are connected to the data driving circuit 220 through the demultiplexer circuit 250. The first gate driving circuit 240 may be connected to a left end (e.g., a left side) of the one group of gate lines GL1 to GLn−1, and the second gate driving circuit 260 may be connected to a right end (e.g., a right side) of the other group of gate lines GL2 to GLn. The one group of gate lines GL1 to GLn−1 may be odd-numbered gate lines, and the other group of gate lines GL2 to GLn may be even-numbered gate lines.

FIG. 6 illustrates only some of the plurality of pixels. Each of the plurality of pixels PX11 to PXnm are connected to a corresponding gate line of the plurality of gate lines GL1 to GLn, and a corresponding data line of the plurality of data lines DL1 to DLm.

The plurality of pixels PX11 to PXnm may be subdivided into a plurality of groups according to the colors being displayed. The plurality of pixels PX11 to PXnm may display one of the primary colors. The primary colors may include red, green, blue, and/or white. However, the primary colors are not limited thereto, and may further include various colors such as yellow, cyan, and/or magenta.

The first and second gate driving circuits 240 and 260 and the data driving circuit 220 receive control signals from the driving controller 230. The driving controller 230 may be mounted on a main circuit board MCB. The driving controller 230 receives image data and control signals from an external graphic control part. The control signals may include a vertical synchronization signal, a horizontal synchronization signal, a data enable signal which is at a high level only during an interval in which the data is outputted to indicate a region where the data is inputted, and clock signals.

The first and second gate driving circuits 240 and 260 generate gate signals on the basis of the control signal (hereinafter, referred to as a gate control signal) received from the driving controller 230 through a signal lines GSL1 and GSL2, respectively, and outputs the gate signals to the plurality of gate lines GL1 to GLn. The first and second gate driving circuits 240 and 260 may be concurrently (e.g., simultaneously) formed with the pixels PX11 to PXnm through a thin film process. For example, the first and second gate driving circuits 240 and 260 may be mounted in the non-display region NDA as an oxide semiconductor TFT gate driver (OSG) circuit.

The data driving circuit 220 generates gray scale voltages according to image data provided from the driving controller 230 on the basis of the control signal (hereinafter, referred to as a data control signal) received from the driving controller 230. The data driving circuit 220 outputs the gray scale voltages as data output signals DO1 to DOm/2 to the demultiplexer circuit 250.

The data output signals DO1 to DOm/2 may include positive data voltages having positive values and/or negative data voltages having negative values, with respect to a common voltage. Some of the data output signals DO1 to DOm/2 applied to the data lines DL1 to DLm may have positive polarity, and some of the data output signals DO1 to DOm/2 applied to the data lines DL1 to DLm may have negative polarity. The polarity of the data output signals DO1 to DOm/2 may be inverted for every frame to prevent or reduce the deterioration of liquid crystals. The data driving circuit 220 may generate data voltages inverted for each frame interval in response to an inverting signal.

The data driving circuit 220 may include a driving chip 222 and a flexible circuit board 221 on which the driving chip is mounted. The data driving circuit 220 may include a plurality of driving chips 222 and a plurality of flexible circuit boards 221. The flexible circuit board 221 electrically connects the main circuit board MCB to the first substrate DS1. The plurality of driving chips 222 provide data output signals DO1 to DOm/2 to drive corresponding data lines of the plurality of data lines DL1 to DLm FIG. 6 exemplarily illustrates a tape carrier package (TCP) data driving circuit 220. However, the inventive concept is not limited thereto, and in some embodiments of the inventive concept, the data driving circuit 220 may be arranged on the non-display region NDA through a chip on glass (COG) method. Each of the plurality of pixels PX11 to PXnm illustrated in FIG. 6 may have an equivalent circuit that is the same or substantially the same as that illustrated in FIG. 2.

Since the operations of the first and second gate driving circuits 240 and 260 and the data driving circuit 220 illustrated in FIG. 6 are similar to the operations of the gate driving circuit 110 and the data driving circuit 120 illustrated in FIG. 1, repeat descriptions will not be provided.

The demultiplexer circuit 250 includes a switching control circuit 259 and a plurality of demultiplexers 251 to 25*m*/2. The demultiplexer circuit 250 may be arranged on a portions of the non-display region NDA of the display panel 210 adjacent to the data driving circuit 220.

In response to a selection signal SEL, a precharge signal PRE_C, and a discharge signal DIS_C from the driving controller 230, the switching control circuit 259 controls switching operations of the plurality of demultiplexers 251 to 25*m*/2.

The plurality of demultiplexers 251 to 25*m*/2 respectively correspond to the data output signals DO1 to DOm/2 outputted from the data driving circuit 220. Each of the demultiplexers 251 to 25*m*/2 sequentially outputs the corresponding data output signal to two data lines. For example, the demultiplexer 251 sequentially provides the first and second data lines DL1 and DL2 with the data output signal DO1. The demultiplexer 252 sequentially provides the third and fourth data lines DL3 and DL4 with the data output signal D02. Likewise, the demultiplexer 25*m*/2 sequentially provides the (m−1)th and mth data lines DLm−1 and DLm with the data output signal DOm/2. Since the configurations of the switching control circuit 259 and the plurality of demultiplexers 251 to 25*m*/2 in the demultiplexer circuit 250 are same or substantially the same as those illustrated in FIG. 4, repeat descriptions will not be provided.

Figure 7:
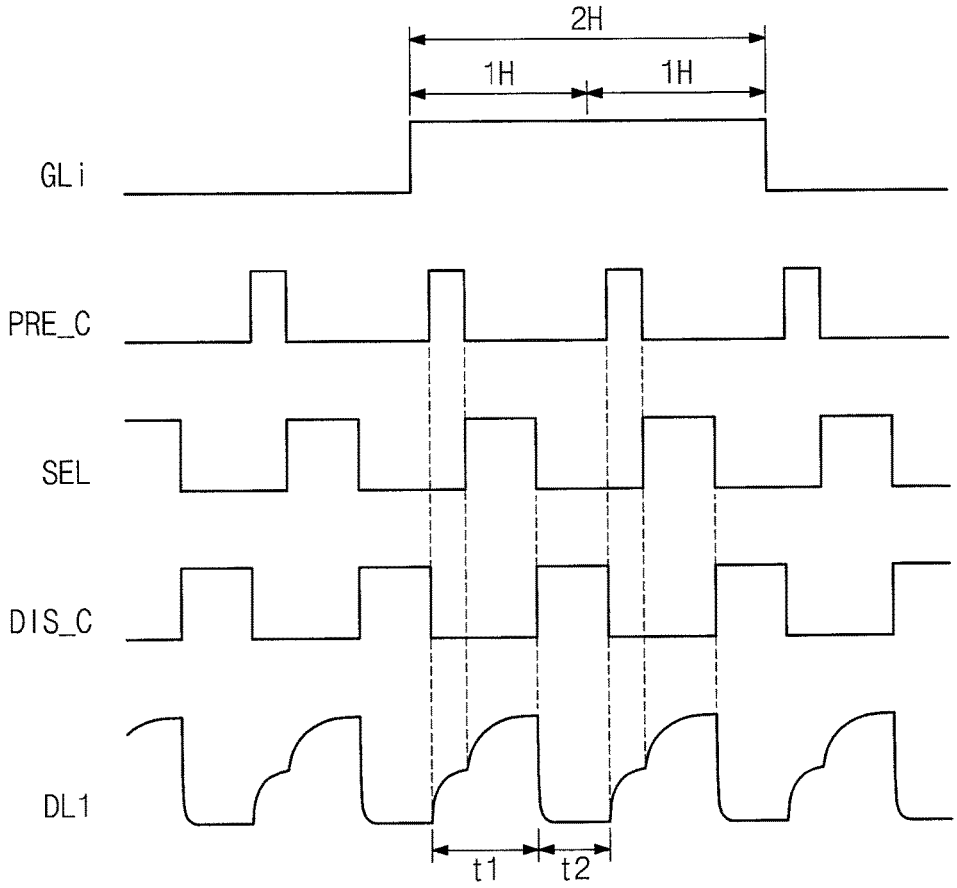
FIG. 7 is a timing diagram of an operation of the demultiplexer illustrated in FIG. 6.

FIG. 7 is a timing diagram of an operation of the demultiplexer illustrated in FIG. 6.

Referring to FIGS. 6 and 7, the precharge signal PRE_C, the selection signal SEL, and the discharge signal DIS_C are sequentially activated to a high level during two horizontal periods 2H, during which the ith gate line GLi of the plurality of gate lines GL1 to GLn is driven with a high-level gate driving signal.

Although the ith gate line GLi is maintained at a high level during one horizontal period 1H in the timing diagram illustrated in FIG. 5, it may be understood that the ith gate line GLi is maintained at a high level during the two horizontal periods 2H in the timing diagram illustrated in FIG. 7. This is because the gate lines GL1 to GLn are driven through an interlacing method by the two gate driving circuits 240 and 260. The first one horizontal period 1H of the two horizontal period 2H is a precharge interval, and the second one horizontal period 1H is a main charge interval.

The precharge signal PRE_C, the selection signal SEL, and the discharge signal DIS_C are sequentially and alternately activated to a high level during the two horizontal periods 2H, and the data output signal DO1 is provided to the first and second data lines DL1 and DL2.

Figure 8:
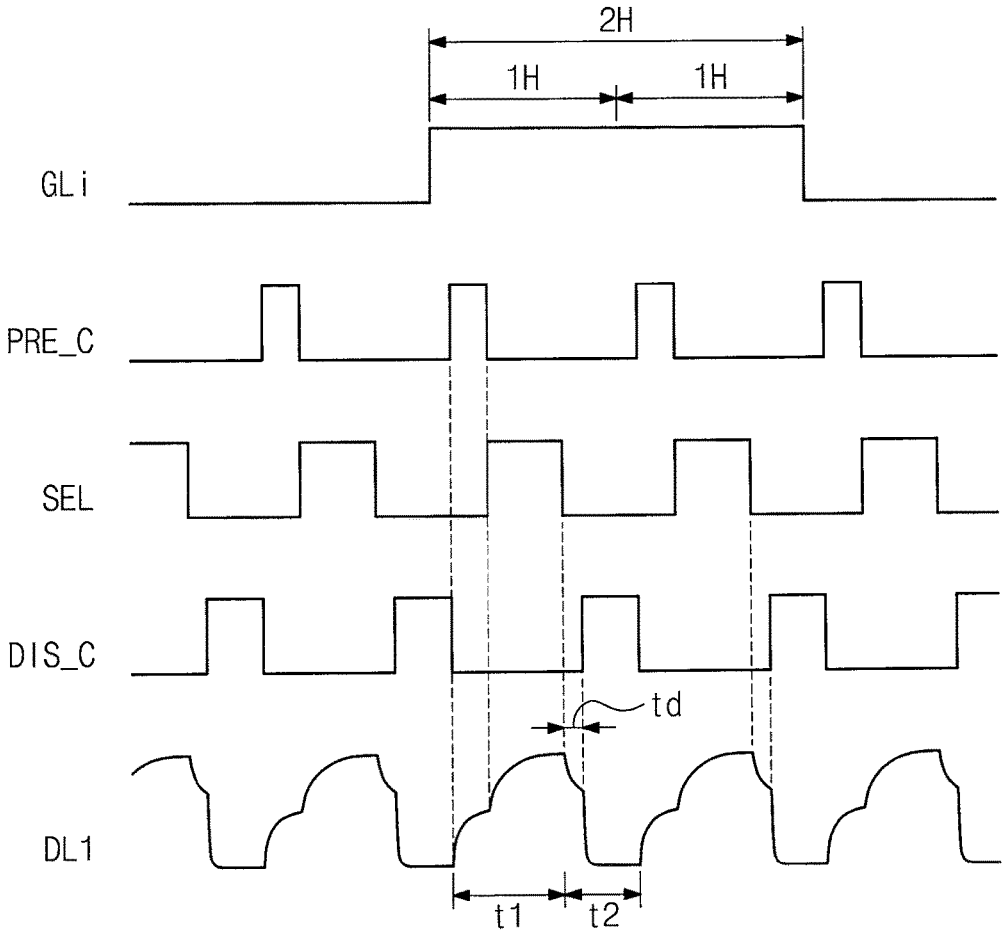
FIG. 8 is a timing diagram of an operation of the demultiplexer illustrated in FIG. 6 according to another embodiment.

FIG. 8 is a timing diagram of an operation of the demultiplexer illustrated in FIG. 6 according to another embodiment.

Referring to FIG. 8, the discharge signal DIS_C provided from the driving controller 230 illustrated in FIG. 6 is provided after being delayed by a delay time (e.g., a predetermined delay time) td with respect to the discharge signal DIS_C illustrated in FIG. 7. That is, the discharge signal DIS_C illustrated in FIG. 8 has a smaller pulse width than that of the discharge signal DIS_C illustrated in FIG. 7.

Referring to FIG. 4, when the signal of the first node N1 is transited from the high level to the low level, the voltage of the first data line DL1 is reduced by a level (e.g., a predetermined level) by the parasitic capacitance between the first node N1 and the first data line DL1. This is referred to as a kickback voltage. The kickback voltage, as previously described in FIG. 4, increases as the voltage level of the first node N1 increases. By delaying a timing at which the discharge signal DIS_C is transited to the high level, that is, by delaying a timing at which the signal level of the first node N1 is discharged to the ground voltage, the influence of the kickback voltage may be reduced or minimized.

Figure 9:
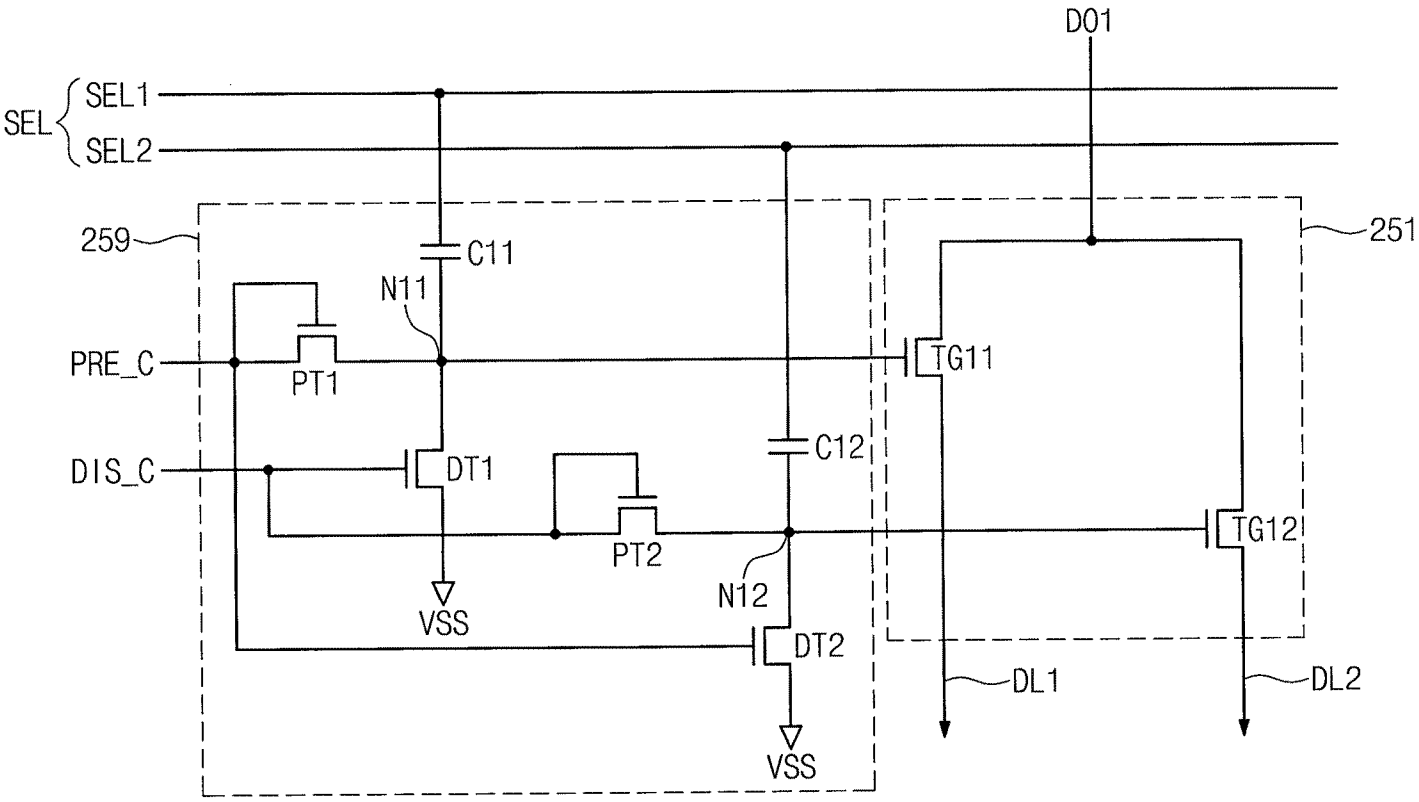
FIG. 9 is a circuit diagram illustrating a configuration of the demultiplexer circuit illustrated in FIG. 6 according to another embodiment.

FIG. 9 is a circuit diagram illustrating a configuration of the demultiplexer circuit illustrated in FIG. 6 according to another embodiment. In FIG. 9, although only the demultiplexer 251 in the demultiplexer circuit 250 is illustrated and described, the other demultiplexers 252 to 25*m*/2 may have the same or substantially the same circuit configurations, and may similarly operate.

Also, the driving controller 230 illustrated in FIG. 6 provides the demultiplexer circuit 250 with a selection signal SEL, a precharge signal PRE_C, and a discharge signal DIS_C. In some embodiments, the selection signal SEL includes first and second selection signals SEL1 and SEL2.

Referring to FIG. 9, the switching control circuit 259 includes first and second precharge transistors PT1 and PT2, first and second discharge transistors DT1 and DT2, and first and second capacitors C11 and C12.

The first precharge transistor PT1 includes a first electrode connected to the precharge signal PRE_C, a second electrode connected to a first node N11, and a control electrode to be controlled by the precharge signal PRE_C. The first precharge transistor PT1 has a diode-connected structure. The first discharge transistor DT1 includes a first electrode connected to the first node N11, a second electrode connected to a voltage VSS (e.g., a ground voltage), and a control electrode connected to the discharge signal DIS_C. The first capacitor C11 is connected between the first selection signal SEL1 and the first node N11.

The second precharge transistor PT2 includes a first electrode connected to the discharge signal DIS_C, a second electrode connected to a second node N12, and a control electrode to be controlled by the discharge signal DISC. The second precharge transistor PT2 has a diode-connected structure. The second discharge transistor DT2 includes a first electrode connected to the second node N12, a second electrode connected to the voltage VSS (e.g., the ground voltage), and a control electrode connected to the precharge signal PRE_C. The second capacitor C12 is connected between the second selection signal SEL2 and the second node N12.

The demultiplexer 251 includes a first switching transistor TG11 and a second switching transistor TG12. The first switching transistor TG11 includes a first electrode connected to the data output signal DO1, a second electrode connected to the first data line DL1, and a gate electrode connected to the first node N11. The second switching transistor TG12 includes a first electrode connected to the data output signal DO1, a second electrode connected to the second data line DL2, and a gate electrode connected to the second node N12.

First, when the precharge signal PRE_C is activated to a high level, the first precharge transistor PT1 is turned on to increase the voltage of the first node N11 to a level of the precharge signal PRE_C. The first switching transistor TG11 is turned on as the voltage of the first node N11 increases. Here, the data output signal DO1 is provided to the first data line DL11 through the first switching transistor TG11. When the precharge signal PRE_C is transited to a low level, the first precharge transistor PT1 is turned off. Also, when the precharge signal PRE_C is activated to a high level, the second discharge transistor DT2 is turned on and the second node N2 is thus discharged to the ground voltage VSS.

When the first selection signal SEL1 is transited to a high level, the voltage of the first node N11 increases from a voltage level of the precharge signal PRE_C by a voltage level of the first selection signal SEL1 through the first capacitor C11. As a signal with a high voltage (for example, 30V) is provided to the control electrode of the first switching transistor TG11, the first switching transistor TG11 is sufficiently (e.g., effectively) turned on, and the data output signal DO1 is transferred to the first data line DL1.

When the discharge signal DIS_C is transited to a high level, the first discharge transistor DT1 is turned on and the first node N11 is thus discharged to the ground voltage VSS. Therefore, the first switching transistor TG11 is turned off.

Also, when the discharge signal DIS_C is activated to a high level, the second precharge transistor PT2 is turned on and the voltage of the second node N12 is thus increased to the voltage level of the precharge signal PRE_C. The second switching transistor TG12 is turned on as the voltage of the second node N12 increases. Here, the data output signal DO1 is provided to the second data line DL2 through the second switching transistor TG12.

When the second selection signal SEL2 is transited to a high level, the voltage of the second node N12 increases from the discharge signal DIS_C level by a voltage level of the second selection signal SEL2 through the second capacitor C12. As a signal with a high voltage (for example, 30V) is provided to the control electrode of the second switching transistor TG12, the second switching transistor TG12 is sufficiently (e.g., effectively) turned on, and the data output signal DO1 is transferred to the second data line DL2.

Subsequently, when the precharge signal PRE_C is activated to a high level, the second discharge transistor DT2 is turned on and the second node N12 is thus discharged to the ground voltage VSS. Therefore, the second switching transistor TG12 is turned off. In this way, the data output signal DO1 may be sequentially provided to the first and second data lines DL1 and DL2.

The display apparatus having a configuration as that of one or more embodiments described above may reduce the number of data driving circuit ICs by including a demultiplexer circuit. Particularly, the display apparatus according to embodiments of the inventive concept may charge a pixel during a precharge interval, and may supply a high voltage to a gate terminal of a transistor in the demultiplexer during a main charging interval, and thus, the decrease in pixel charge ratio caused by a voltage drop in the transistor of the demultiplexer may be minimized or reduced.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Unless otherwise defined, all terms (including technical and scientific terms) used herein have the same meaning as commonly understood by one of ordinary skill in the art to which the inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

While exemplary embodiments are described above, a person skilled in the art may understand that various modifications may be made without departing from the spirit and scope of the present invention defined in the following claims, and their equivalents. Also, embodiments disclosed in the present disclosure are not intended to limit the spirit and scope of the present invention, and the following claims and their equivalents are to be construed as being included in the spirit and scope of the present invention.

What is claimed is:

1. A display apparatus, comprising:

a display panel including a plurality of pixels respectively connected to a plurality of gate lines and a plurality of data lines;

a data driving circuit configured to output a data output signal in response to a data signal;

a demultiplexer circuit configured to provide first and second data lines from among the plurality of data lines with the data output signal outputted from the data driving circuit, in response to control signals; and a driving controller configured to provide the data driving circuit with the data signal, and to provide the demultiplexer circuit with the control signals, wherein the demultiplexer circuit comprises:

a switching transistor including a first electrode configured to receive the data output signal, a second electrode connected to the first data line, and a gate electrode connected to a first node; and a switching control circuit configured to charge the first node in response to the control signals to turn on the switching transistor during a first interval of a first horizontal period, and to discharge the first node during a second interval of the first horizontal period in response to the control signals.

2. The display apparatus of claim 1, wherein:

the control signals provided from the driving controller include a selection signal and a precharge signal; and the switching control circuit is configured to charge the first node in response to the selection signal and the precharge signal to turn on the switching transistor during the first interval of the first horizontal period.

3. The display apparatus of claim 2, wherein the switching control circuit comprises:

a precharge transistor including a first electrode configured to receive the precharge signal, a second electrode connected to the first node, and a control electrode to be controlled by the precharge signal; and a capacitor connected between a source line of the selection signal and the first node.

4. The display apparatus of claim 3, wherein the precharge signal and the selection signal include pulse signals that are sequentially activated during the first interval of the first horizontal period.

5. The display apparatus of claim 4, wherein a pulse width of the precharge signal is smaller than a pulse width of the selection signal.

6. The display apparatus of claim 1, wherein the control signals provided from the driving controller include a discharge signal, and the switching control circuit is configured to discharge the first node in response to the discharge signal to turn off the switching transistor during the second interval of the first horizontal period.

7. The display apparatus of claim 6, wherein the switching control circuit comprises a discharge transistor including a first electrode connected to the first node, a second electrode connected to ground, and a control electrode to be controlled by the discharge signal.

8. The display apparatus of claim 7, wherein the discharge signal includes a pulse signal activated during the second interval of the first horizontal period.

9. The display apparatus of claim 1, wherein the data driving circuit is configured to output a first data output signal provided to the pixels connected to the first data line during the first interval of the first horizontal period, and to output a second data output signal provided to the pixels connected to the second data line during the second interval of the first horizontal period.

10. The display apparatus of claim 1, further comprising a gate driving circuit configured to drive the plurality of gate lines, wherein the driving controller is configured to control the gate driving circuit to sequentially drive the plurality of gate lines.

11. The display apparatus of claim 10, wherein the gate driving circuit is arranged adjacent to one side of the display panel.

12. The display apparatus of claim 1, further comprising:

a first gate driving circuit configured to drive one group of gate lines from among the plurality of gate lines; and a second gate driving circuit configured to drive another group of gate lines from among the plurality of gate lines, wherein the driving controller is configured to control the first and second gate driving circuits to sequentially drive the plurality of gate lines.

13. The display apparatus of claim 12, wherein the first gate driving circuit is arranged adjacent to a first side of the display panel, and the second gate driving circuit is arranged adjacent to a second side of the display panel facing the first side.

14. The display apparatus of claim 12, wherein each of the first and second gate driving circuits comprises an oxide semiconductor TFT gate (OSG) d river.

15. A method for driving a display apparatus, the method comprising:

outputting a data output signal in response to a data signal;

increasing a voltage level of a first node connected to a capacitor, in response to a precharge signal;

electrically connecting the data output signal and a first data line to provide the first data line with the data output signal, in response to the voltage level of the first node;

electrically connecting the data output signal and the first data line to provide the first data line with the data output signal, in response to a selection signal;

preventing a data output end and the first data line from being electrically connected, in response to a discharge signal; and providing a second data line with the data output signal via the data output end, wherein the voltage level of the first node increases from a voltage level of the precharge signal by a voltage level of the selection signal when the selection signal is transited to a high level.

16. The method of claim 15, wherein the precharge signal and the selection signal include pulse signals that are sequentially activated during a first interval of a first horizontal period.

17. The method of claim 16, wherein a pulse width of the precharge signal is smaller than a pulse width of the selection signal.

18. The method of claim 16, wherein the discharge signal includes a pulse signal activated during a second interval of the first horizontal period.

19. The method of claim 18, wherein the outputting of the data output signal in response to the data signal comprises:

outputting a first data output signal to pixels connected to the first data line during the first interval of the first horizontal period; and outputting a second data output signal to pixels connected to the second data line during the second interval of the first horizontal period.

20. A system for driving a display apparatus, the system comprising:

means for outputting a data output signal in response to a data signal;

means for electrically connecting the data output signal and a first data line to provide the first data line with the data output signal, in response to a precharge signal;

means for electrically connecting the data output signal and the first data line to provide the first data line with the data output signal, in response to a selection signal;

means for preventing a data output end and the first data line from being electrically connected, in response to a discharge signal; and means for providing a second data line with the data output signal from the data output end.

* * * * *